US007581972B2

(12) United States Patent
Daamen

(10) Patent No.: US 7,581,972 B2
(45) Date of Patent: Sep. 1, 2009

(54) BUSBAR CONNECTION SYSTEM

(75) Inventor: Ron Daamen, Vught (NL)

(73) Assignee: Tyco Electronics Nederland B.V., 's-Hertogenbosch (NL)

( * ) Notice: Subject to any disclaimer, the term of this patent is extended or adjusted under 35 U.S.C. 154(b) by 0 days.

(21) Appl. No.: 12/191,157

(22) Filed: Aug. 13, 2008

(65) Prior Publication Data

US 2009/0047814 A1 Feb. 19, 2009

(30) Foreign Application Priority Data

Aug. 13, 2007 (EP) ..... 07015898

(51) Int. Cl.
*H01R 13/64* (2006.01)

(52) U.S. Cl. ..... 439/249

(58) Field of Classification Search ..... 439/249, 439/251, 939, 845, 843; 200/282
See application file for complete search history.

(56) References Cited

U.S. PATENT DOCUMENTS 3,566,335 A 2/1971 Powell
3,656,093 A * 4/1972 Kinkaid ..... 439/872
4,174,147 A * 11/1979 Waddington et al. ..... 439/636
4,867,713 A * 9/1989 Ozu et al. ..... 439/833
5,431,576 A 7/1995 Matthews
6,280,205 B1 * 8/2001 Murowaki et al. ..... 439/79
2002/0160648 A1 * 10/2002 Bulmer et al. ..... 439/393

FOREIGN PATENT DOCUMENTS

WO 02/061891 A1 8/2002

* cited by examiner

*Primary Examiner*—Phuong K Dinh
(74) *Attorney, Agent, or Firm*—Barley Snyder LLc

(57) ABSTRACT

A busbar connection system includes at least two pluggable connectors spaced apart from each other a predetermined distance. Each of the pluggable connectors has an opening for receiving a conductor. At least one contact member for contacting the conductor is provided inside each of the openings. The contact member is rotatable about an axis in a direction transverse to a mating direction of the conductors. At least one urging member engages the contact member and biases the contact member in the direction transverse to the mating direction of the conductors.

11 Claims, 7 Drawing Sheets

BUSBAR CONNECTION SYSTEM

CROSS-REFERENCE TO RELATED APPLICATIONS

This application claims the benefit of the filing date under 35 U.S.C. § 119(a)-(d) of European Patent Application No. EP 07 015 898.5, filed Aug. 13, 2007.

FIELD OF THE INVENTION

The present invention is directed to a busbar connection system and an electrical system comprising such a busbar connection system.

BACKGROUND

Busbar connection systems are commonly used in particular in electrical power distribution systems in order to distribute electrical power from a power source to a number of electrical devices. Such an electrical power distribution system usually comprises at least two conductors which are spaced apart from each other in a predetermined distance for being connected to a number of electrical devices. Each of the electrical devices comprises at least two pluggable connectors in order to respectively connect to one of the conductors. The pluggable connectors of every device are spaced apart from each other in the predetermined distance of the two conductors of the electrical power system. The conductors are typically realized as vertical strip conductors spaced apart a predetermined distance, such as about 25 mm. Due to manufacturing tolerances, the distance between the conductors can have a variation of more than about 1 mm. However, known standard busbar systems allow only for a very small variation, e.g., 0.1 to 0.15 mm, in the predetermined distance. The conductors and the connectors therefore have to be produced and installed with high accuracy, which results in high manufacturing costs.

SUMMARY

Accordingly, it is an object of the invention to provide an improved busbar connection system which can be used with a less accurately manufactured pair of conductors while providing reliable electrical connections.

This and other objects are achieved by a busbar connection system comprising at least two pluggable connectors spaced apart from each other a predetermined distance. Each of the pluggable connectors has an opening for receiving a conductor. At least one contact member for contacting the conductor is provided inside each of the openings. The contact member is rotatable about an axis in a direction transverse to a mating direction of the conductors. At least one urging member engages the contact member and biases the contact member in the direction transverse to the mating direction of the conductors.

DETAILED DESCRIPTION OF THE EMBODIMENT(S)

Figure 1:
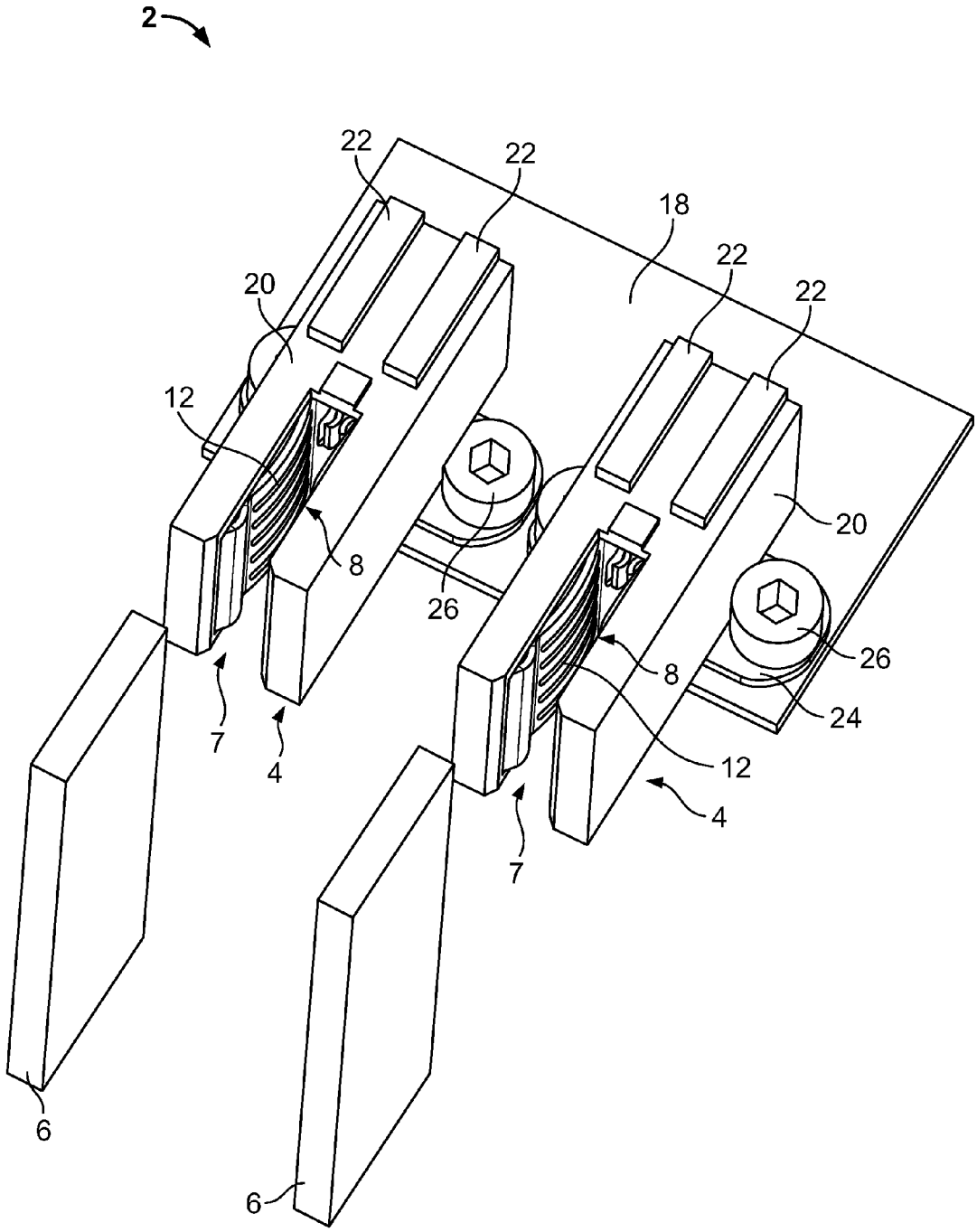
FIG. 1 is a partially exploded perspective schematic view of a busbar connection system comprising two pluggable connectors.

FIG. 1 shows a perspective schematic view of an exemplary busbar connection system 2 according to the invention. The busbar connection system 2 comprises two pluggable connectors 4 which are fixed side by side via respective fixtures 24 and screws 26 to a printed circuit board 18. Alternatively, the fixtures 24 may be fixed by press-fit contacts or soldering to the printed circuit board 18. Each of the connectors 4 has a U-shaped form with an opening 7 which opens to a front facing away from the printed circuit board 18. A contact member 8 is arranged on each side of each of the openings 7 basically extending over their entire height. Each of the contact members 8 has a curved form with an arcuate contact zone 12 protruding into the opening 7. The connectors 4 are covered by respective housings 20, which are made of plastic. Two guiding tracks 22 are arranged on the rear top of each of the housings 20. The guiding tracks 22 are arranged to accommodate corresponding protrusions (not visible) which are formed on a top of a rear part 8*c* of each of the contact members 8 in order to fix the contact members 8 to the housing 20, as shown in FIG. 2.

An electrical conductor 6 is arranged in front of each of the connectors 4. The conductor 6 is typically 3 mm wide and at least 15 mm in depth and can have a length (height) of up to several meters. The conductors 6 of this type are typically used in power distribution systems, where several electrical devices such as the printed circuit boards 18 are arranged over one another, each of the electrical devices comprising the busbar connection system 2 for receiving electrical power from the conductors 6. Each of the conductors 6 may be introduced into the opening 7 of the connector 4 in order to establish electrical connection between the contact member 8 and the conductor 6.

Figure 2:
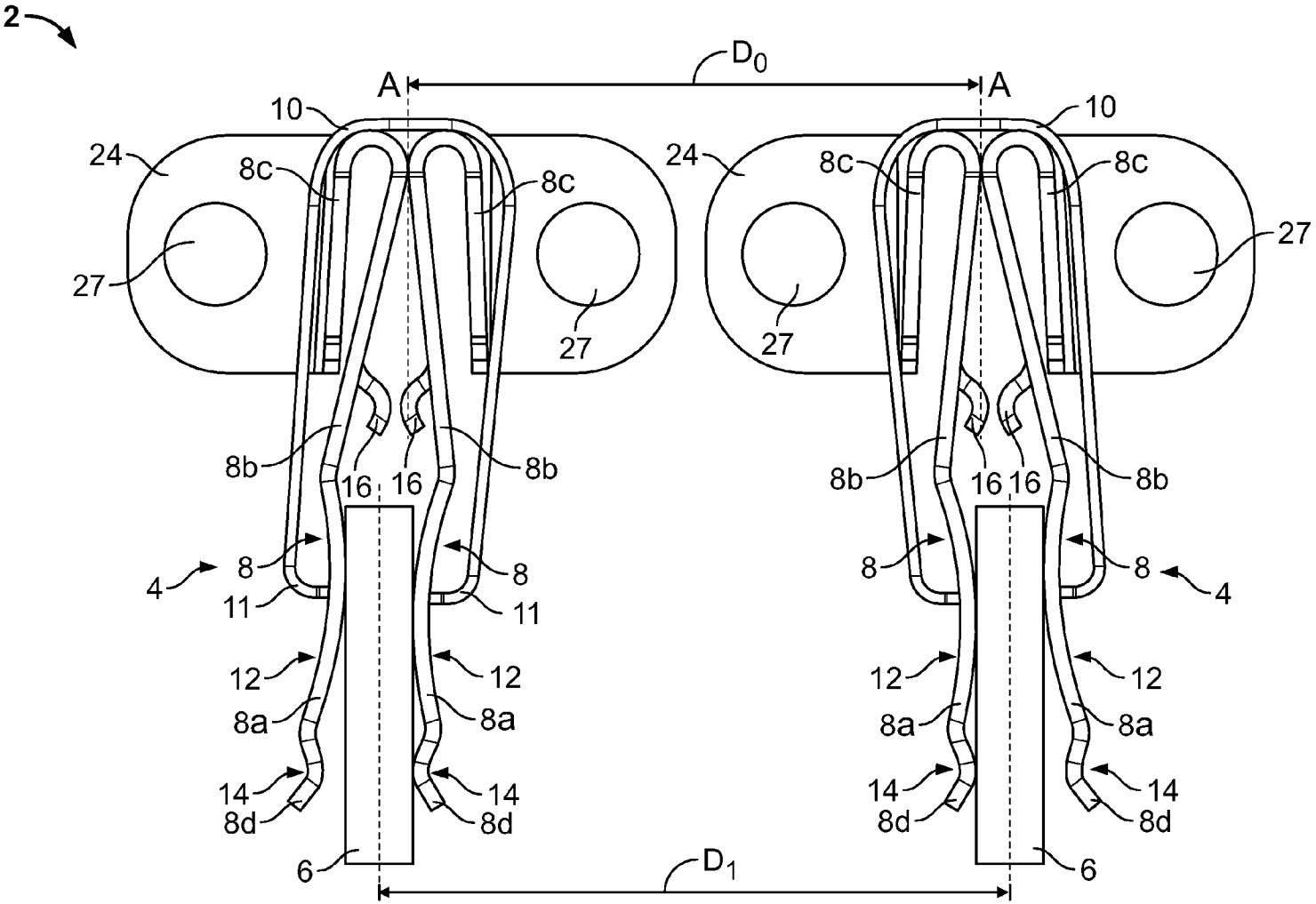
FIG. 2 is a schematic top view of the busbar connection system of FIG. 1 shown without housings wherein each of the connectors are connected to conductors which are spaced apart a distance which is greater than a predetermined distance.

As shown in FIG. 2, the connectors 4 are fixed to the printed circuit board 18 via the fixtures 24 and the screws 26 which extend through respective holes 27 in the fixtures 24. Each of the connectors 4 comprises two of the contact members 8 inversely facing each other with the conductor 6 introduced into the opening 7 between them from the front (bottom of FIG. 2). Each of the contact members 8 is formed from a metal strip. The rear part 8*c* of each of the contact members 8 is bent in an angle of more than about 180° with respect to a middle part 8*b*. An arcuate contact zone 12 is formed from the front part 8*a* of each of the contact members 8 in order to contact the conductor 6. The rear part 8*c* of each of the contact members 8 is fixed to the fixture 24. The middle part 8*b* and the front part 8*a* are not fixed to the fixture 24 and thus they can move in a plane extending parallel to the printed circuit board 18. Due to its bent shape, each of the contact members 8 executes a resilient force on the conductor 6 if it is introduced in between two of the contact members 8. Between the contact zone 12 and the distal end 8*d* of each of the contact members 8, a curved sacrificial zone 14 is formed in order to cause any electrical arcs, which may occur when the conductor 6 is pulled out from the connector 4 while power-on thereby interrupting the electrical current, to occur at the sacrificial zone 14 in order to avoid that the contact zone 12 is damaged by the electrical arcs.

In the middle part 8*b* of each of the contact members 8 a stop 16 is formed in order to maintain a predetermined distance between the contact members 8. The stop 16 may be formed protruding out of the contact member 8 by cutting out and bending a section of the contact member 8. The stop 16 causes a predetermined gap between the contact members 8 even if none of the conductors 6 are introduced between them. This facilitates introducing the conductor 6.

The contact members 8 of the connectors 4 are arranged so that in an idle state, in which none of the conductors 6 are introduced into the connectors 4, planes A, which extend vertically between the contact members 8 of each of the connectors 4 parallel to the contact members 8 and the insertion direction of the conductor 6, are spaced apart in a predetermined distance $D_0$. A typical value for said distance $D_0$ is about 25 mm.

An urging member clasps the contact members 8 of each of the connectors 4. In the embodiment shown in FIG. 2 the urging member is a clip 10 made of stainless steel which clasps the contact members 8 from behind, i.e. from the side opposite to the side where the contact member 8 is introduced. However, alternative urging members, such as springs, can be used as well. Each of the clips 10 basically has a U-shape, which envelopes and contacts the rear parts 8*c* of the contact members 8 and opens to the front side. The contact members 8 extend through the opening. At its front end, the clip 10 comprises two front portions 11 which are bent inwardly in order to contact the contact member 8 in the contact zone 12. The clip 10 is resiliently biased executing a force on the contact zones 12 of the contact members 8 in order to urge the contact members 8 in a direction of each other onto the conductor 6, respectively.

As a distance $D_1$ between the conductors 6 is larger than the predetermined distance $D_0$, the contact members 8 and the clip 10 are shifted from an initial position to the outside in order to adjust for the difference between the distance $D_1$ and the predetermined distance $D_0$. A typical value for the distance $D_1$ is about 26.5 mm. This shifting can be performed by resiliently bending the metal connection between the rear part 8*c* of each of the contact members 8 and the fixture 24. Alternatively, the rear part 8*c* may be fixed to one of the fixtures 24 so that the contact members 8 are rotatable around an axis which is positioned in the middle between the contact members 8 and extends perpendicular to the circuit board. Due to the urging force executed by the clip 10 onto the contact members 8, a reliable electrical connection between the contact zone 12 of the contact members 8 and the conductor 6 is ensured. In a particular embodiment, the contact members 8 and the clips 10 are configured to permit compensating for a deviation of the distance $D_1$ between the conductors 6 from the predetermined distance $D_0$ of up to about 2 mm.

Figure 3:
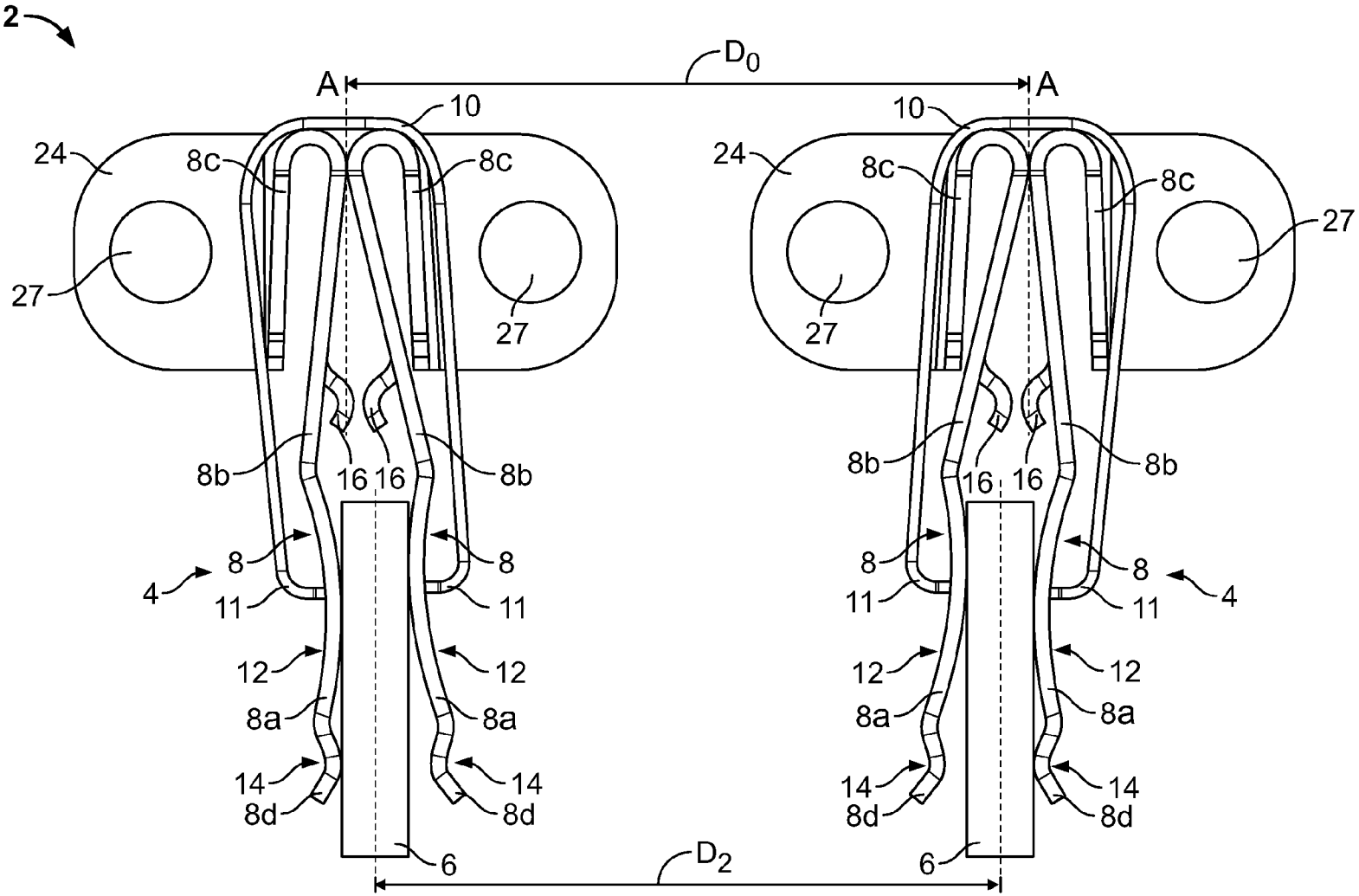
FIG. 3 is a schematic top view of the busbar connection system of FIG. 1 shown without housings wherein each of the connectors are connected to conductors which are spaced apart is distance which is smaller than a predetermined distance.

FIG. 3 shows a sectional top view of the same busbar connection system 2 shown in FIG. 2. The same reference signs designate the same features which will not be discussed in detail again. In the embodiment shown in FIG. 3 the distance $D_2$ between the conductors 6 is smaller than the predetermined distance $D_0$. A typical value for the distance $D_2$ is about 23.5 mm. As the distance $D_2$ of the conductors 6 is smaller than the predetermined distance $D_0$, the contact members 8 of each of the connectors 4 are shifted to the inside in order to adjust for the smaller distance $D_2$. This shifting can be performed by resiliently bending the metal connection between the rear part 8*c* of each of the contact members 8 and the fixture 24. Alternatively, the rear parts 8*c* may be fixed to the fixture 24 so that they are rotatable around an axis which is positioned in the middle between the contact members 8 and extends perpendicular to the printed circuit board 18. A reliable electrical connection between each of the conductors 6 and the contact zones 12 of the contact members 8 is ensured by the force executed by each of the clips 10 urging the contact zones 12 of the contact members 8 in the direction of the conductor 6.

Figure 4A:
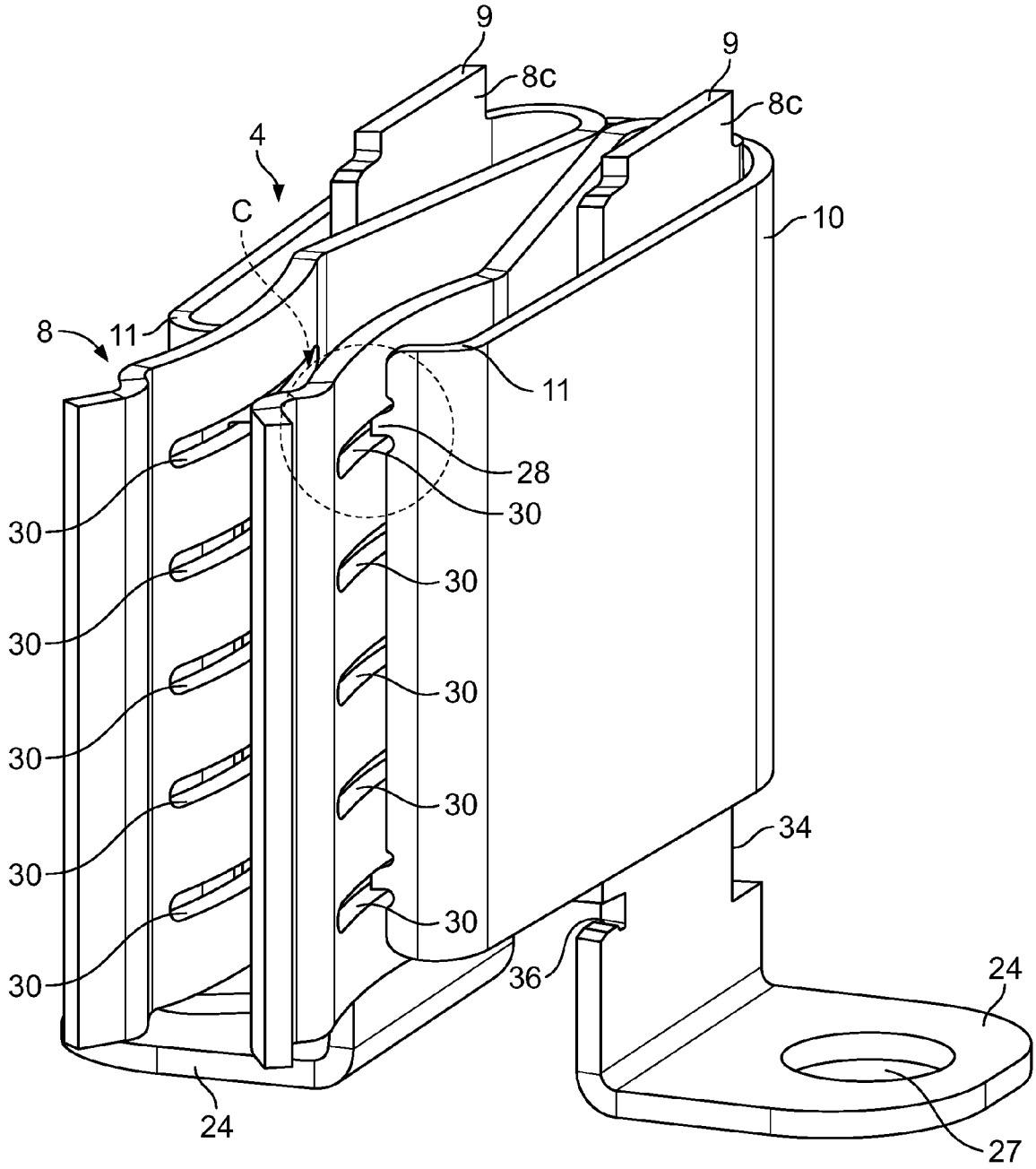
FIG. 4*a* is a perspective front view of a single connector of a busbar connection system according to the previous figures shown without a housing.
Figure 4B:
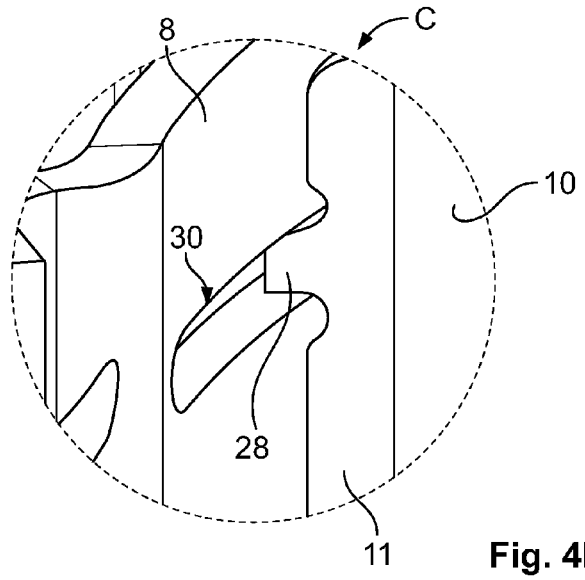
FIG. 4*b* is an enlarged detailed view of FIG. 4*a*.

As shown in FIGS. 4*a*-4*b*, the contact members 8 are enveloped and clasped by the clip 10. At its two front ends the clip 10 comprises the front portions 11 which are bent inwardly in order to contact the contact member 8 in the contact zone 12. At each of the front portions 11 two protrusions 28 are formed at the edge bent inwards, respectively. In the contact zones 12 of each of the contact members 8, where the clip 10 contacts the contact member 8, five grooves 30 are formed. The grooves 30 run horizontally and are arranged in a vertical row on top of each other. The two protrusions 28 of each of the front portions 11 are inserted into the highest and the lowest of the grooves 30 of the contact member 8, respectively. As the clip 10 is resiliently biased this secures the clip 10 to the contact members 8. At the front side of each of the fixtures 24, a slot 36 is formed for accommodating part of the housing 20 when attached to the connector 4. At the back side of the fixtures 24, an edge 34 is formed for engaging with an appropriate hook of the housing 20.

Figure 5:
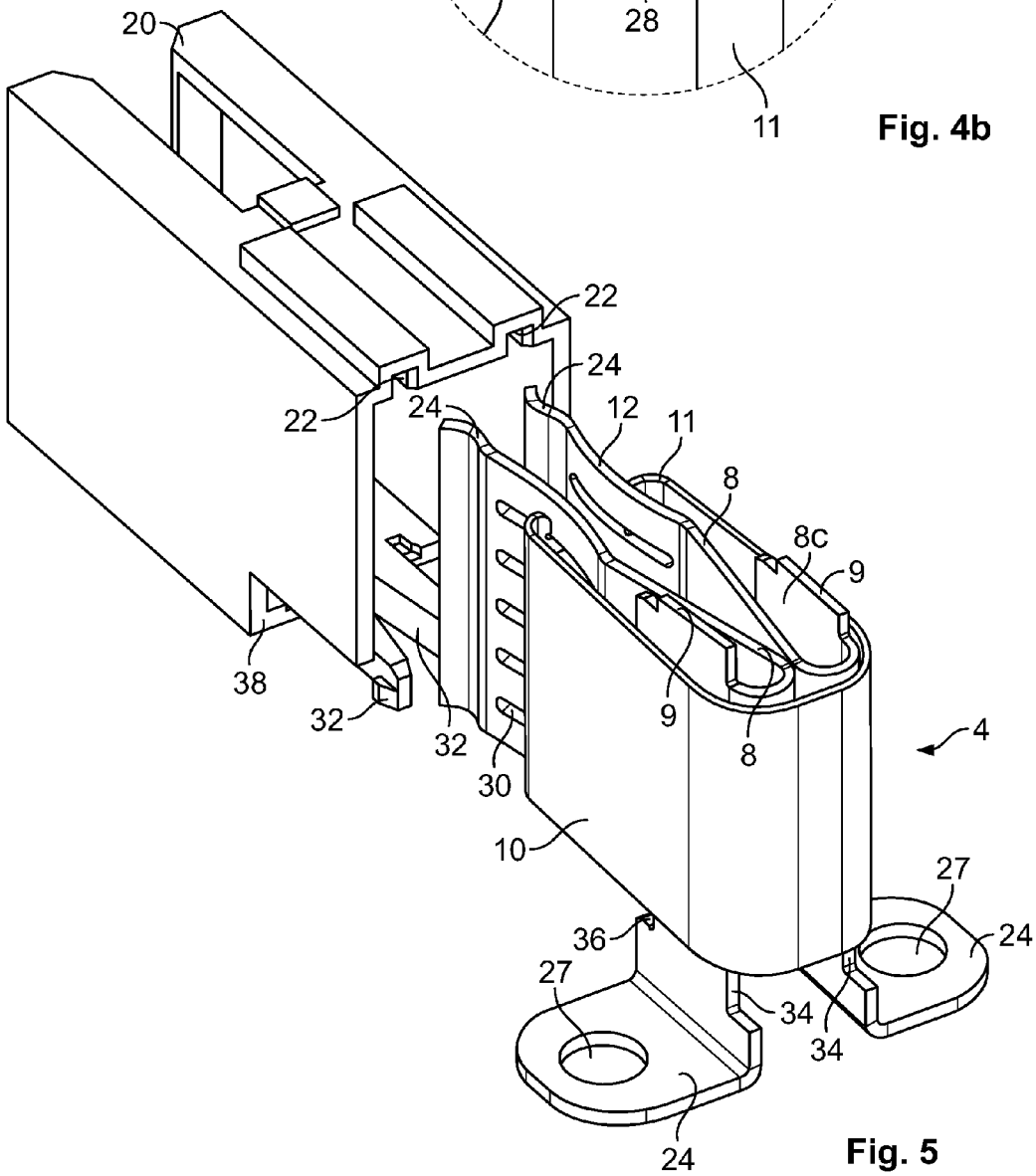
FIG. 5 is a partially exploded perspective view from behind of the single connector of FIGS. 4*a*-4*b* shown with the housing, which has not yet been fixed to the connector.

As shown in FIG. 5, the housing 20 comprises the guiding tracks 22 at its rear top in order to accommodate the guiding rails 9 which are formed at the top of the rear part 8*c* of each of the contact members 8. The guiding rails 9 will be inserted into the guiding tracks 22 when the housing 20 is pushed over the contact members 8 and the clip 10. This will secure the rear parts 8*c* of the contact members 8 to the housing 20 and thus enhance the stability of the connector 4. At the bottom of the housing 20 two resilient hooks 32 are formed inversely opposite to each other facing to the outside. When the housing 20 is pushed over the contact members 8 and the clip 10, the hooks 32 will engage with the edges 34 at the back of the fixtures 24, respectively, in order to secure the housing 20 to the fixture 24. This prevents the housing 20 from dropping off of the connector 4.

Figure 6A:
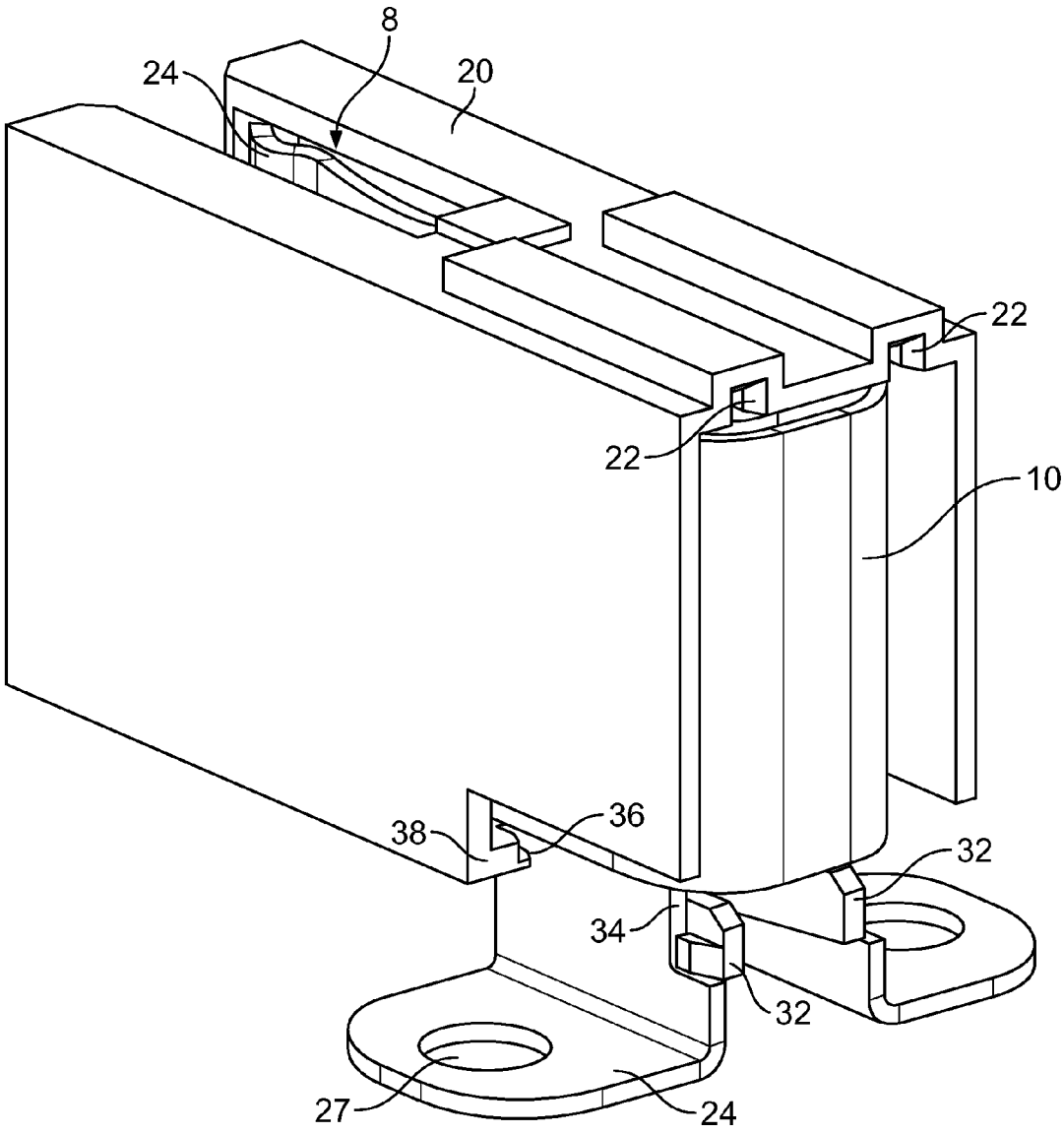
FIG. 6*a* is a perspective view of the connector of FIGS. 4*a*-5 from the back side showing the housing fixed to the connector.
Figure 6B:
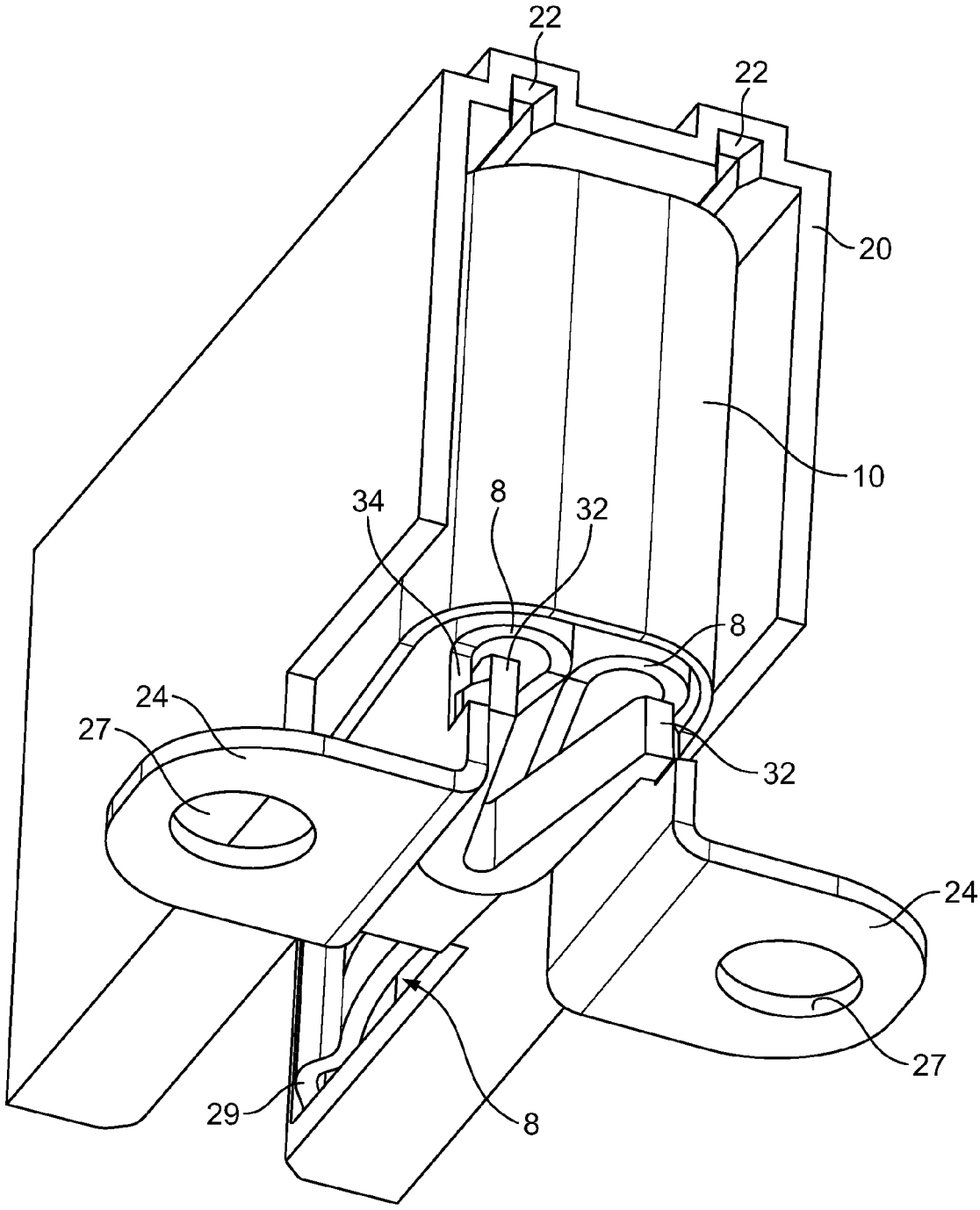
FIG. 6*b* is a perspective view of the connector of FIGS. 4*a*-5 from the bottom showing the housing fixed to the connector.

FIGS. 6*a*-6*b* show the connector 4 of FIGS. 4*a*-5 from the back side and from the bottom, respectively, wherein the housing 20 has been fixed to the connector 4. The housing 20 covers the top and the sides of the contact members 8 and the clip 10, but it is open to the back side. A bottom section 38 of the housing 20 is introduced into the slots 36 formed at the front side of each of the fixtures 24. The hooks 32 formed at the bottom of the housing 20 engage with the edges 34 at the back side of the fixtures 24. The guiding rails 9 on top of the rear parts 8*c* of the contact members 8 (not visible) are introduced into the guiding tracks 22 formed in the top of the housing 20. This arrangement provides a very stable configuration and allows a considerable large contact force to be executed on the conductor 6 in order to ensure a reliable electrical connection.

The busbar connection system 2 according to an exemplary embodiment of the invention, as described above, allows deviations in the distance between at least two of the conductors 6 from the predetermined distance $D_0$ to be absorbed. In order to ensure a reliable electrical connection, the clip 10 urging the contact members 8 against the conductor 6 is used in order to provide a necessary contact force even in a worst case situation. The busbar connection system 2 comprising the connectors 4 according to the invention can be produced easily and at low costs as the essential components can be formed conveniently from flat metal strips. The invention facilitates the assembly of electrical systems, particularly electrical power distribution systems, since larger tolerances in the distance between the conductors 6 are allowed. This reduces the cost for producing such an electrical system.

The foregoing illustrates some of the possibilities for practicing the invention. Many other embodiments are possible within the scope and spirit of the invention. It is, therefore, intended that the foregoing description be regarded as illustrative rather than limiting, and that the scope of the invention is given by the appended claims together with their full range of equivalents.

What is claimed is:

1. A busbar connection system, comprising:

at least two pluggable connectors spaced apart from each other a predetermined distance, each of the pluggable connectors having an opening for receiving a conductor;

at least one contact member for contacting the conductor provided inside each of the openings, the contact member being rotatable about an axis in a direction transverse to a mating direction of the conductors;

at least one guiding track that receives a guiding rail on the contact member in order to fix the contact member to a housing of at least one of the connectors; and at least one urging member engaging the contact member and biasing the contact member in the direction transverse to the mating direction of the conductors.

2. The busbar connection system of claim 1, wherein at least one of the contact member and the urging member of at least one of the connectors is bendable in the direction transverse to the mating direction of the conductors.

3. The busbar connection system of claim 1, wherein the urging member is a U-shaped clip.

4. The busbar connection system of claim 1, wherein the connectors are fixed to a printed circuit board.

5. The busbar connection system of claim 1, wherein the contact members are rotatable up to about 2 mm.

6. The busbar connection system of claim 1, wherein the urging member has at least one protrusion at a front portion thereof and the contact member has at least one groove that accommodates the protrusion.

7. The busbar connection system of claim 1, wherein the contact member is a metal strip.

8. The busbar connection system of claim 1, wherein the contact member of at least one of the connectors has a curved contact zone for contacting the conductor and the urging member biases the contact member at the contact zone.

9. The busbar connection system of claim 8, wherein the contact member has a curved sacrificial zone for causing electrical arcs arranged between the contact zone and a distal end of the contact member.

10. The busbar connection system of claim 1, wherein at least one of the connectors comprises two of the contact members, the contact members facing each other such that the opening is formed there between.

11. The busbar connection system of claim 10, wherein at least one of the contact members facing each other is provided with a stop that maintains a gap between the contact members.

* * * * *